United States Patent [19]

Schleicher et al.

[11] 4,346,681

[45] Aug. 31, 1982

[54] APPARATUS FOR FUEL METERING, AND IN PARTICULAR, SUPPLEMENTARY FUEL METERING, BY MEANS OF A SPECIAL METERING DEVICE IN AN EXTERNALLY IGNITED INTERNAL COMBUSTION ENGINE

[75] Inventors: Rolf Schleicher, Leinfelden; Lutz Seebald, Möglingen; Walter Seitz, Filderstadt, all of Fed. Rep. of Germany

[73] Assignee: Robert Bosch GmbH, Stuttgart, Fed. Rep. of Germany

[21] Appl. No.: 93,094

[22] Filed: Nov. 9, 1979

[30] Foreign Application Priority Data

Nov. 9, 1978 [DE] Fed. Rep. of Germany ..... 2848563

[51] Int. Cl.[3] ..... F02B 3/00; F02N 17/08

[52] U.S. Cl. ..... 123/179 L; 123/179 A

[58] Field of Search ..... 123/179 L, 179 A, 179 B, 123/180 T, 492

[56] References Cited

U.S. PATENT DOCUMENTS

| | | | |
|---|---|---|---|
| 3,646,917 | 3/1972 | Nagy | 123/179 A |
| 3,756,213 | 9/1973 | Miyaki et al. | 123/179 L |
| 3,855,975 | 12/1974 | Masaki et al. | 123/179 B |
| 4,089,317 | 5/1978 | Drews et al. | 123/179 L |
| 4,150,654 | 4/1979 | Heitzman et al. | 123/179 L |
| 4,157,084 | 6/1979 | Wallis | 123/179 L |
| 4,216,757 | 8/1980 | Romann | 123/179 L |

FOREIGN PATENT DOCUMENTS

| | | | |
|---|---|---|---|
| 2036380 | 6/1980 | United Kingdom | 123/179 L |

OTHER PUBLICATIONS

"Fuel Injection–Continuous Injection System", Published by Robert Bosch GmbH, West Germany, Feb. 1974, pp. 16, 20, 21.

*Primary Examiner*—P. S. Lall

*Attorney, Agent, or Firm*—Edwin E. Greigg

[57] ABSTRACT

An apparatus for fuel metering, in particular supplementary fuel metering, in an externally ignited internal combustion engine by means of a special metering device, in particular an injection valve, wherein the special metering device is triggerable at least from time to time with pulses under special operating conditions such as cold starting, hot starting, or acceleration, or in order to enable emergency operation of the internal combustion engine. To this end, the apparatus comprises, besides the special metering device, a stroke transducer, which depending on the special operating state to be controlled, is connected with the output of the starting switch or with the output of the driving switch of the internal combustion engine or of the vehicle.

11 Claims, 5 Drawing Figures

APPARATUS FOR FUEL METERING, AND IN PARTICULAR, SUPPLEMENTARY FUEL METERING, BY MEANS OF A SPECIAL METERING DEVICE IN AN EXTERNALLY IGNITED INTERNAL COMBUSTION ENGINE

The invention relates generally to fuel metering apparatus for an internal combustion engine and more particularly, to a fuel metering apparatus for supplementary fuel metering, including cold start fuel enrichment.

BACKGROUND OF THE INVENTION

In a continuously functioning, mechanical fuel injection system, so-called starting enrichment by means of a cold-start valve is known, which injects an additional fuel quantity into the intake manifold during the starting process in accordance with the position of a thermo-time switch. For example, the technical instruction booklet entitled "Fuel Injection Continuous Injection System (CIS)," published in 1974 by Robert Bosch GmbH, D-7 Stuttgart 1, Postfach 50, West Germany, on page 16 therein, describes an auxillary starting assembly which consists essentially of an electromagnetically-operated start valve for spraying additional fuel into the common intake manifold of an internal combustion engine, which is switched on at the beginning of the engine starting process, and a thermal-time switch, which is mounted on engine block to sense engine temperature and which limits the duration of time that the start valve is opened, or, at higher engine temperature, prevents this valve from opening at all. The thermal-time switch closes or opens the power circuit leading to the start valve depending on the engine temperature. During cold starting, the power circuit is interrupted depending on the temperature of a bimetallic strip which is heated by a heating coil during the starting operation. When the switching temperature is reached, the thermal-time switch is opened, cutting off power to the start valve, and the heating coil maintains the switch open until the end of the starting operation. When rapid heating of the bimetallic strip is desired, the thermal-time switch may include a second heating coil which is switched off when the thermal-time switch opens.

This known special metering apparatus, with its one-time on-off switching, canot be adapted precisely enough to a required additional fuel quantity. Also, it has proved to be desirable for the special fuel metering apparatus to function not only in the event of starting a cold internal combustion engine, but in other events as well.

OBJECT AND SUMMARY OF THE INVENTION

The apparatus in accordance with the invention, has the advantage over the prior art by providing a general means, in case of need, of special fuel metering, with this special metering being adjustable both with respect to its intensity and with respect to its duration. The special metering may thus be used as a means of both post-starting enrichment and acceleration enrichment. Finally, there is the possibility of maintaining emergency operation of the internal combustion engine shoulder the regular fuel metering apparatus fail.

The invention will be better understood as well as further objects and advantages thereof become more apparent from the ensuing detailed description of preferred embodiments taken in conjunction with the drawings.

DESCRIPTION OF THE PREFERRED EMBODIMENTS

The various figures of the drawings relate to special fuel metering devices with their wiring, in externally ignited internal combustion engines.

Figure 1:
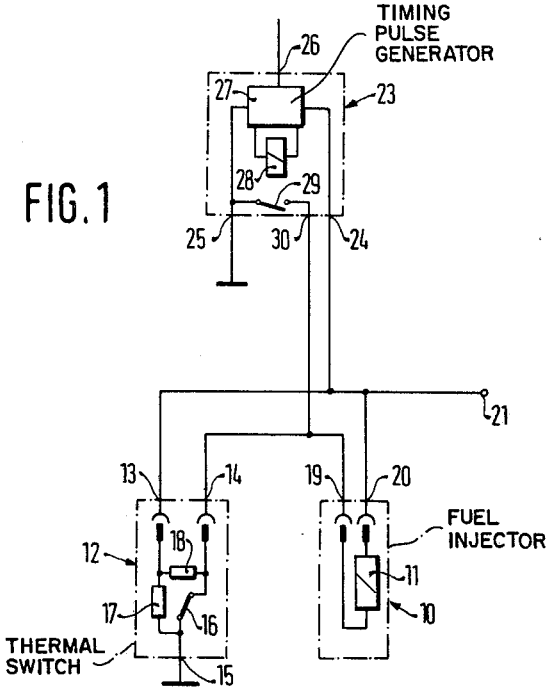
FIG. 1 is a schematic diagram of the special fuel metering apparatus of the invention showing its use in hot starting.

In FIG. 1, an injection valve is designated by the reference numeral 10, which upon the energization of its energizing coil 11 can inject fuel into the intake manifold of an internal combustion engine. A thermo-time switch, which may be similar to the known thermal-time switches described above in the background of the invention, is indicated by reference numeral 12. It has two inputs 13 and 14 and an output 15 connected to ground. It contains a switch 16 which is closed below a certain temperature and whose behavior over time is determined by the amount of heat given up by a heating resistor 17.

Between the inputs 13 and 14 there is an additional resistor 18. The input 14 is connected with one of the two terminals 19 and 20 of the energizing coil 11 of the injection valve 10, while the other terminal 20 of this energizing coil 11 and the input 13 of the thermo-time switch 12 are connected with an input terminal 21. This input terminal 21 is generally designated as "terminal 50" and is at the same time the signal line for the starter motor. This means that a positive signal is present at this input terminal 21 only during the starting process, that is, during starter actuation.

A timing pulse generator 23 has a supply voltage input 24 connected to the input terminal 21 and a supply voltage output 25 connected to ground. The timing pulse generator 23 contains a pulse transducer 27, controllable as needed via an input 26, for a relay coil 28, whose energization causes a switch 29 to close. While one side of this switch 29 is connected with the output 25 of the timing pulse generator 23 and thus with ground, the other side of this switch 29 is connected via an input 30 with the connection point of the input 14 of the thermo-time switch 12 and with the terminal 19 of the injection valve 10.

If the operator of a vehicle equipped with this internal combustion engine actuates the starting switch, then a positive signal is present at the input terminal 21. When the internal combustion engine is cold, the switch 16 is closed and thus the energizing coil 11 of the magnetic valve 10 is energized, and additional fuel proceeds through the injection valve into the air intake manifold of the internal combustion engine. At the same time, the timing pulse generator 23 is connected with the supply voltage, and the switch 29 is consequently closed and opened again in a pulsed manner.

After a certain period of time has elapsed, the resistor 17 in the thermo-time switch 12 reaches the response temperature of the switch 16, so that this switch opens. As a result, only the switch 29 in the timing pulse generator 23 still furnishes the connection to ground for the energizing coil 11 of the injection valve 10. For this reason, the injection valve 10 opens and closes in alternation until the end of the starter actuation by the operator. Two phases of differing time-related injection quantity may thus be distinguished here during the starter actuation. So long as the thermo-time switch 12 has not shut off, the injection valve 10 is operated in the continuous-wave phase. After it shuts off, for the remaining duration of the starting process there is a pulsed injection of an increased fuel quantity, during which the keying ratio, i.e., duty cycle, of the switch 29 and thus the keying ratio of the on-off operation of the injection valve can be controlled via the input 26 of the timing pulse generator 23.

It should be noted that in the arrangement of FIG. 1, the injection valve 10 is opened (if only in a pulsed manner) upon each starting process. The amount of the increased fuel quantity thereby injected may be set via the keying ratio of the switch actuation 29. Known so-called cold start enrichment means comprise only one injection valve 10 and the thermo-time switch 12. It has been demonstrated, however, that even in the event of so-called hot starting, a certain increased quantity of fuel is required, because as a result of the high temperatures, vapor bubbles can form in the injection lines and thus the metering performed via the normal fuel metering devices is no longer sufficiently precise. Therefore, it is efficient to apply a temperature-dependent signal at the control input 26 of the timing pulse generator 23, in order to be able to actuate the injection valve 10 in a temperature-dependent manner for the purpose of obtaining the desired special quantity.

Figure 2:
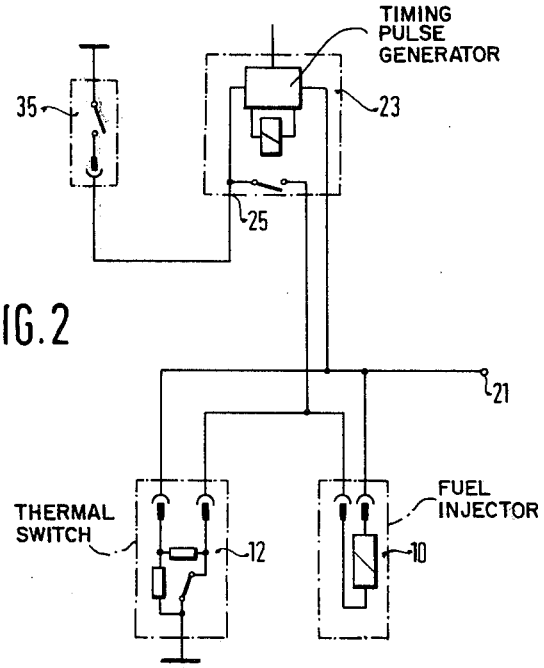
FIG. 2 is a diagram similar to FIG. 1 showing the use of the invention as a temperature-dependent starting enrichment.

FIG. 2 shows an apparatus for the control of a special fuel quantity which is slightly modified in comparison with the circuit arrangement of FIG. 1. The difference is only in that the output 25 of the timing pulse generator 23 is not directly connected to ground but rather via a temperature switch 35, which is closed either below or above certain temperatures. In this manner, either a graduated control of increased quantity for cold engine starting can be accomplished, or a pronounced control of increased quantity for hot starting, which then is effective only above a certain temperature threshold.

Figure 3:
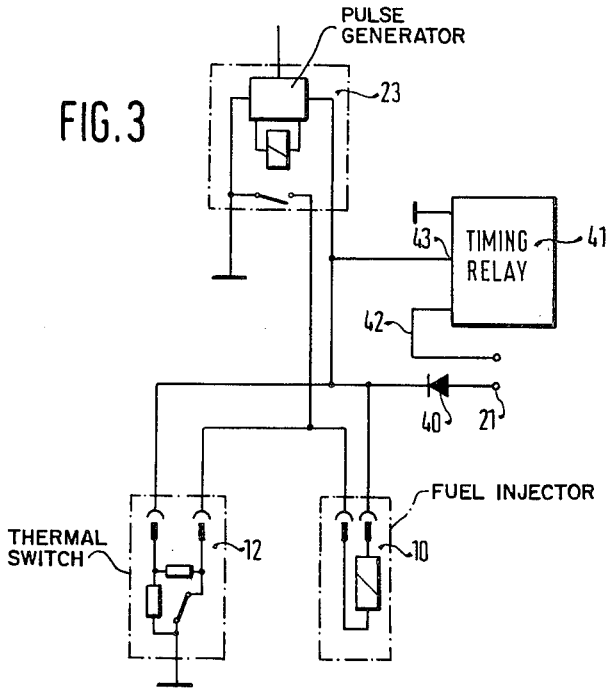
FIG. 3 is a diagram similar to FIG. 1 showing the use of the invention as a post-starting boost.

FIG. 3 shows one possible arrangement for accomplishing post-starting boost or warm-up enrichment. Here, it should be noted that the input terminal 21 is connected via a diode 40 with the injection valve 10, thermo-time switch 12 and timing pulse generator 23. Further, the circuit arrangement of FIG. 3, differing from that of FIG. 1, includes a preferably controllable timing relay 41, which, on the input side, is continuously connected with the vehicle voltage source via a connecting line 42 after the driving switch of the vehicle is switched on. The switch output 43 of the timing relay 41 is linked with the cathode side of the diode 40, which provides the feeding of voltage to the timing pulse generator 23 and valve 10 even after the starting process. The switching of the timing relay 41 must, in accordance with its nature, be adapted to the warm-up behavior of the particular internal combustion engine in which it is used, so that an appropriate increased fuel quantity can be made available during the warm-up phase.

Figure 4:
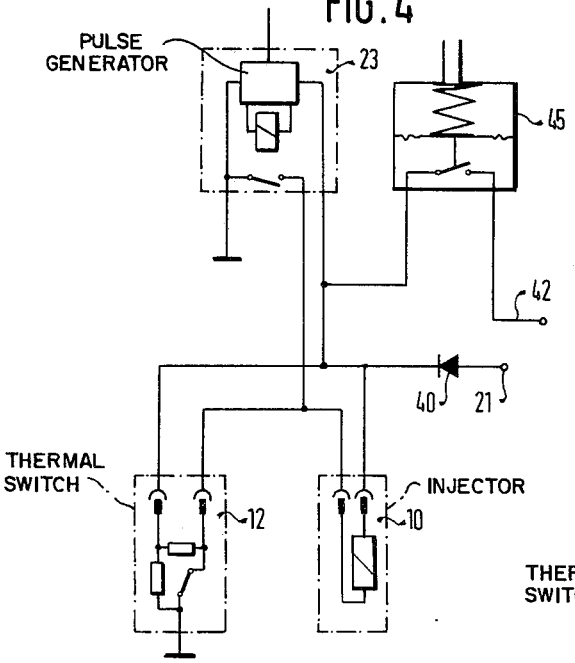
FIG. 4 is a diagram similar to FIG. 1 showing the use of the invention as an acceleration enrichment.

FIG. 4 is a diagram of a circuit arrangement for the purpose of acceleration enrichment. The timing relay 41 of FIG. 3 is simply replaced by an acceleration recognition switch 45 which, in the illustrated embodiment, is provided by means of a pressure jump switch connected to the intake manifold. In the arrangement of FIG. 4, the valve 10 is thus actuated outside the starting phase whenever an acceleration process occurs, whereupon the amount of the acceleration enrichment is adapted to the switching behavior of the pressure jump switch in the acceleration recognition switch 45.

Figure 5:
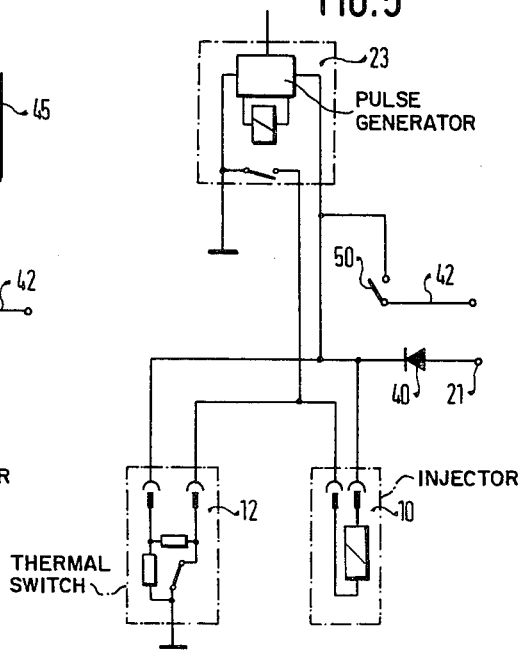
FIG. 5 is a diagram similar to FIG. 1 showing the use of the invention as an emergency operation fuel metering device.

Finally, FIG. 5 shows a circuit arrangement for assuring emergency operation of the internal combustion engine. In FIG. 5, the line 42 which carries voltage during driving operation of the internal combustion engine can be connected via a switch 50 which is normally opened, with the timing pulse generator 23, injection valve 10 and thermo-time switch 12, whenever the normal fuel metering, accomplished via the carburetor system, for example, or via a special injection system, has failed.

The five circuit arrangements described above in various special operations of the internal combustion engine, permit an opening of the special metering device in the form of the injection valve 10. Each of the five circuit arrangements are activated by an operating voltage provided between an input and an output of the apparatus. The three interconnected inputs 13, 20 and 24 of the thermal time switch 12, injection valve 10, and timing pulse generator 23, respectively, constitute the apparatus input, and the ground connections of the apparatus constitute the apparatus output. The time-related quantity may be varied via the keying ratio of the trigger signal of the injection valve 10 via a control input 26 of the timing pulse generator 23. It will be appreciated that the injection valve 10 can also be provided by means of an additional and controllable carburetor in the air intake manifold of an internal combustion engine. What is essential is only that there is a special metering location in the air intake manifold which, under selected special operational states, delivers a predetermined quantity or increased quantity.

The foregoing relates to preferred exemplary embodiments of the invention, it being understood that other embodiments and variants thereof are possible within the spirit and scope of the invention, the latter being defined by the appended claims.

What is claimed and desired to be secured by letters patent of the United States is:

1. A supplementary fuel metering apparatus for an internal combustion engine which comprises:

an electrical input of the apparatus;

an electrical output of the apparatus;

apparatus actuating means for providing an operating voltage between said input and said output at predetermined times and operating conditions of the engine;

a voltage-actuated fuel metering device;

a timing pulse generator which includes pulse transducer means, connected between said input and said output and actuated by the operating voltage, for generating electrical pulses, and switch means, actuated by the electrical pulses generated by the pulse transducer means, for periodically connecting the fuel metering device between said input and said output; and thermal time switch means for connecting the fuel metering device across said input and said output for at least an initial portion of each time period that the operating voltage is provided between said input and said output, whenever a sensed temperature is below a predetermined temperature value at the beginning of said time period.

2. A fuel metering apparatus, as described in claim 1, wherein the apparatus actuating means comprises starting switch means for providing said operating voltage between said input and said output during a starting operation of the engine.

3. A fuel metering apparatus, as described in claim 1, wherein the fuel metering device comprises a fuel injection valve.

4. A fuel metering apparatus, as described in claim 1, wherein the thermal time switch means comprises:

a temperature-activated switch which is closed when the sensed temperature is below the predetermined temperature value to connect the fuel metering device across said input and said output, and a resistor, connected between said input and said output of the apparatus, for producing heat to raise the sensed temperature whenever the operating voltage is provided between said input and said output.

5. A fuel metering apparatus as described in claim 1, wherein the pulse transducer means comprises control means for adjusting the keying ratio of the electrical pulses generated by the pulse generator in accordance with a temperature-dependent signal supplied to the control means.

6. A fuel metering apparatus, as described in one of claims 1, 2, and 5, which further comprises a thermal switch which is disposed in series with the switch means of the timing pulse generator and which is closed whenever a temperature sensed by this thermal switch is below a predetermined low temperature value or above a predetermined high temperature value, and which is open whenever its sensed temperature is intermediate the low and high temperature values.

7. A fuel metering apparatus, as described in claim 1, wherein the apparatus actuating means comprises:

timing relay means, actuated by the operating voltage, for providing the operating voltage between said input and said output for a controllable time period; and driving switch means for providing the operating voltage to the timing relay means to actuate the timing relay means during the operation of the engine.

8. A fuel metering apparatus, as described in claim 7, wherein the switching of the timing relay means is adapted to the warm-up behavior of the engine.

9. A fuel metering apparatus, as described in claim 1, wherein the apparatus actuating means comprises an acceleration recognition switching means for providing the operating voltage between said input and said output during an acceleration process of the engine.

10. A fuel metering apparatus, as described in claim 9, wherein the acceleration recognition switching means comprises a pressure jump switch connected to an intake manifold of the engine.

11. A fuel metering apparatus, as described in claim 1, 2, 7 or 9 wherein the apparatus actuating means comprises a normally open switch, which may be closed to provide the operating voltage between said input and said output whenever normal fuel metering for the engine fails, to thus activate the apparatus and assure fuel metering during emergency operation of the engine.

* * * * *